US008915551B2

(12) United States Patent
Rees et al.

(10) Patent No.: US 8,915,551 B2
(45) Date of Patent: Dec. 23, 2014

(54) APPARATUS AND METHOD FOR PRODUCING ROUND BRUSHES

(75) Inventors: Thomas Rees, Todtnau (DE); Peter Steinebrunner, Schonau (DE); Fabian Matt, Aitern (DE); Mathias Grossmann, Todtnau (DE); Markus Kaiser, Schonenberg (DE); Markus Wunderle, Aitern (DE)

(73) Assignee: Zahoransky AG, Todtnau (DE)

( * ) Notice: Subject to any disclaimer, the term of this patent is extended or adjusted under 35 U.S.C. 154(b) by 345 days.

(21) Appl. No.: 13/428,692

(22) Filed: Mar. 23, 2012

(65) Prior Publication Data

US 2012/0240347 A1 Sep. 27, 2012

(30) Foreign Application Priority Data

Mar. 24, 2011 (DE) ..... 10 2011 015 060

(51) Int. Cl.
*A46D 3/05* (2006.01)

(52) U.S. Cl.
CPC ..... *A46D 3/05* (2013.01)
USPC ..... 300/2; 300/21

(58) Field of Classification Search
USPC ..... 300/2, 4, 6, 21; 15/206, 207; 140/115, 140/149
See application file for complete search history.

(56) References Cited

U.S. PATENT DOCUMENTS

| | | | | |
|---|---|---|---|---|
| 3,330,603 | A * | 7/1967 | Gelardi | 300/2 |
| 3,376,073 | A | 4/1968 | Marks et al. | |
| 3,657,870 | A * | 4/1972 | Marks | 57/24 |
| 3,791,421 | A * | 2/1974 | Barrett | 140/149 |
| 4,573,247 | A * | 3/1986 | Spinelli | 29/417 |

FOREIGN PATENT DOCUMENTS

| | | |
|---|---|---|
| DE | 102005045827 | 3/2007 |
| EP | 1917886 | 8/2010 |

* cited by examiner

*Primary Examiner* — Robert Scruggs
(74) *Attorney, Agent, or Firm* — Volpe and Koenig, P.C.

(57) ABSTRACT

An apparatus for producing round brushes, which have bristles twisted in between two portions of a folded wire. The apparatus has a bristle feeding device and a rotary gripper for twisting two portions of wire with bristles located therebetween, a deflecting device with two deflecting rollers spaced apart in the longitudinal direction of the wire. The rotary gripper is linearly displaceable transversely in relation to the longitudinal direction of the wire, for gripping the folded region of the wire that is formed by force being applied by an application element that is adjustable between the deflecting rollers transversely in relation to the longitudinal direction of the wire. A bristle feeding device, for feeding bristles to the bent-around portions of wire, is provided in the region of the deflecting rollers. In the region of the unfolded portions of wire there is provided a device for slowing the advancement of the wire.

32 Claims, 5 Drawing Sheets

APPARATUS AND METHOD FOR PRODUCING ROUND BRUSHES

CROSS-REFERENCE TO RELATED APPLICATIONS

This application claims the benefit of German Patent Application No. 102011015060.9, filed Mar. 24, 2011, which is incorporated herein by reference as if fully set forth.

BACKGROUND

The invention relates to an apparatus and a method for producing round brushes, which have bristles twisted in between two portions of wire of a folded wire, the apparatus having a bristle feeding device and a rotary gripper for twisting two portions of wire with bristles located between them.

Such apparatuses along with associated production methods are known in various forms. For example, EP 1 917 886 B1 discloses a method and an apparatus in which bristles are fed between two portions of wire of a previously folded wire, the portions of wire are twisted at a first winding station to the extent that the bristles are held between the portions of wire and the brush prefabricated in this way is fully twisted, to a desired degree of winding, at a second winding station. However, this is very complex due to the large number of working stations. Moreover, such an apparatus is only suitable for relatively small brushes such as mascara brushes, since in the case of larger brushes with longer bristles the covering material may be flung away by the centrifugal forces acting during the twisting. In order to minimize this effect, it has previously been the practice in the production of larger brushes for the covering material to be held by an operator until the covering material is clamped between the portions of wire. This requires considerable expertise and experience on the part of the operator and presents a hazard for the operator, since he must have his hands in the danger area of the apparatus during the twisting. Moreover, this production method does not represent a safe process and is only possible for brush dimensions that can be handled by an operator.

Although, for example, DE 10 2005 045 827 A1 or U.S. Pat. No. 3,791,421 A disclose apparatuses with which bristle material can be twisted automatically in between two portions of wire, these apparatuses require feeding of two separate portions of wire. As a result, both ends of the brushes must be worked after the twisting in of the covering material and a certain distance is necessary between the head end of the brush and the beginning of the bristle covering.

SUMMARY

There is therefore the object of providing an apparatus and a method of the type mentioned at the beginning with which a round brush which IS formed of a single wire and with which covering with bristles is possible right up to the front end of the round brush can be produced at a single working station.

The solution according to the invention for achieving this object with regard to the apparatus is provided in that a deflecting device with two deflecting rollers spaced apart in the longitudinal direction of a fed wire is provided, that a rotary gripper, which is linearly displaceable transversely in relation to the longitudinal direction of the fed wire, for gripping the folded region of the wire that is formed by force being applied by an application element that is adjustable between the deflecting rollers transversely in relation to the longitudinal direction of the wire is provided, that a bristle feeding device, for feeding bristles to the bent-around portions of wire, is provided in the region of the deflecting rollers, and that in the region of the unfolded portions of wire there is respectively provided a device for slowing the advancement of the wire.

The main working steps, that is to say wire feeding, folding the wire, feeding the bristle covering material and twisting, take place in a single working station. The folding of the wire in the region of the deflecting rollers and the subsequent feeding of the bristles in this region mean that it is possible for the bristle covering to begin directly in the folding region of the wire, so that the covering can reach right up to the free end of the finished round brush. The twisting in of the portions of wire takes place with the aid of the rotary gripper directly downstream of the deflecting rollers at which the bristle feeding takes place. The covering material is therefore firmly held on the wire directly after the feeding, so that the bristles can no longer be flung away by centrifugal forces. An operator is not required for this, which leads to increased safety of the process.

The slowing of the wire in the region of the unfolded portions of wire means that the wire is held under tensile stress during the twisting in of the bristles and the portions of wire are tensioned in the twisting-in region, whereby the pull-out resistance of the bristles in the finished round brush is increased.

The turning of the rotary gripper and the associated twisting of the portions of wire alone have the effect that the wire is drawn around the deflecting rollers and the rotary gripper is thereby pushed linearly away from the deflecting rollers. It is also possible that the rotary gripper is positioned by the tensile force of a tension spring and/or a linear motor.

It may be expedient if the deflecting rollers are respectively assigned a twisting-in roller, arranged at a distance in the direction of the fed wire, and a slowing roller, arranged in between in the wire feeding direction and on the side opposite from the wire.

The wire thereby runs through between the deflecting roller and the twisting-in roller on the one hand and the slowing roller on the other hand. This on the one hand forms a guide for the wire. On the other hand, the wire can be slowed by corresponding positioning of the slowing roller while pressure is applied to the wire.

In this respect it is expedient if the slowing rollers are respectively adjustable transversely in relation to the advancing direction of the wire and transversely in relation to their axial direction. Depending on the positioning of the slowing roller, the pressing force on the wire can be varied, and consequently the slowing force can be changed. The higher the slowing force is set during the twisting in of the bristles, the higher the tensile stress of the portions of wire during the twisting in of the bristles and correspondingly greater the pull-out resistance of the bristles of the finished round brush.

During the feeding of the wire at the beginning of a brush production cycle, the slowing roller may also be kept at such a distance from the deflecting roller and the twisting-in roller that unslowed guiding of the wire between the individual rollers, without pressure being applied, is possible.

The slowing rollers may be respectively activatable and positionable by way of a control unit.

It is also possible that the slowing rollers are assigned measuring elements for measuring the wire tension, which for their part are connected to the control device in order to control the advancement of the wire.

In order to optimize the advancement of the wire, an advancing device for the wire may be provided, which device acts on one of the unfolded portions of wire upstream of one of the deflecting rollers and is in operative connection with a rotary encoder in the region of the other, unfolded portion of wire upstream of the other deflecting roller. On the basis of the measured values of the rotary encoder, the advancement of the other portion of wire, driven by the advancing device, is controlled. As a result, a uniform advancement of the wire from both sides toward the deflecting rollers is ensured.

The advancing device and the rotary encoder may be in operative connection with each other by way of a control device.

However, it is also possible that the rotary encoder is connected directly to a motor control of the advancing device. This makes quick and direct control of the advancement of the wire possible.

A preferred embodiment provides that the advancing device has a driver roller, with a drive, and a counter roller, between which the wire can be guided through, the distance between the driver roller and the counter roller during the advancement of the wire corresponding at least approximately to the diameter of the wire. This makes simple and reliable advancement of the wire possible. It is also possible to perform the feeding and positioning of the wire upstream of the deflecting rollers and past them at the beginning of the production process by means of the advancing device.

It is expedient in this respect if the driver roller has a number of circular disks of different diameters arranged one behind the other in the axial direction and is adjustable in the axial direction. This allows the apparatus to be adapted quickly and easily to different wire diameters by adjusting the driver roller.

The driver roller and the counter roller may in particular be formed concavely on their running surfaces, in order to ensure reliable transporting of the wire.

Alternatively, the driver roller may be cylindrically formed and have on its circumference a number of notches spaced apart in the axial direction for wires of different thicknesses and be adjustable in the axial direction.

The application element for folding the wire may be a bending plate which is adjustable between the deflecting rollers between a bending position, brought closer to the rotary gripper and applying force to the wire guided past the rotary gripper, and a rest position, drawn back in comparison. This makes a correspondingly flat folding of the wire possible, for the forming of a flat brush end.

The application element may, however, also be a gripper finger arranged on the rotary gripper and linearly displaceable with the rotary gripper. This finger is initially arranged on the side of the wire that is opposite from the rotary gripper and is then displaced in the direction of the rotary gripper, so that the gripper finger draws the wire to the rotary gripper and thereby folds it. Downstream of the gripper finger, the wire may be folded together further, until the two portions of wire for receiving the bristles have been brought closer to each other, in order to hold the bristles, so that an eyelet is formed in the region of the gripper finger. In this respect, the form of the eyelet may be determined by the outer contour of the gripper finger. For example, a round eyelet, an oval eyelet or a triangular eyelet may be formed.

It is also possible that the application element has a receptacle for a functional element applying force to the wire. This functional element is partially enclosed by the wire during the folding and consequently remains on the wire after the removal of the finished round brush, whereby for example a handle or else a head-side protective element is formed.

An advantageous embodiment provides that the deflecting rollers are adjustable transversely in relation to the longitudinal direction of the folded portions of wire between a bending position, for the positioning of the application element, and a twisting-in position, brought closer to each other in comparison. The deflecting rollers may be initially spaced apart from each other to such an extent that the application element can be reliably moved between them, in order to fold the wire. Subsequently, after the removal of the application element, the deflecting rollers are moved toward each other, whereby the folded portions of wire are also brought closer to each other, so that they are held so close together that the bristles can be clamped in between and are already held in a clamping manner directly after the feeding.

It is possible that prefabricated wires that have previously been cut to the required length for producing a round brush are fed to the apparatus. However, a preferred embodiment provides that a wire reel is provided as a wire supply for the wire to be fed. As a result, the production process is further simplified, since no upstream device for cutting the wires to length is required. The wire is unwound from the wire reel to the required length and guided past the rotary gripper. The free end of the wire guided past the rotary gripper is then moved back again toward the rotary gripper in the opposite direction during the twisting in of the portions of wire.

In particular when unwinding the wire from a wire reel, the use of a previously described advancing device for the wire may be appropriate, in order to meet the expenditure of force required when unwinding the wire from the wire reel.

If large round brushes are to be produced and the spatial conditions do not allow the free end of the wire to be pulled off straight, it is expedient if a deflecting unit for the free end of the fed wire is provided. The wire is then deflected in a way corresponding to the spatial situation, it being possible for the deflection to be performed by way of deflecting rollers or a hollow guide, in particular in the form of a segment of a circle, through which the wire is pushed.

In order to eliminate curvatures of the wire unwound from the wire reel and ensure that the wire is fed in a straight form in the region of the deflecting rollers, at least one straightening apparatus may be provided downstream of the wire reel in the advancing direction of the wire, with a number of guiding rollers arranged on both sides of the wire for aligning the wire. There may even be two straightening apparatuses provided, arranged offset by 90° in relation to each other in the circumferential direction of the wire, in order to ensure that the wire is aligned straight in all dimensions.

If the free end of the wire is deflected, one or more straightening apparatuses may also be provided in the region of the free end of the wire, between the deflecting roller and the deflecting unit, in order to transform the wire back into a straight alignment.

In order to cut off automatically the wire fed from a wire reel when the required length of wire is reached and avoid manual intervention by an operator, it is expedient if a cutting device for severing the wire fed from a wire reel is provided.

In order that the bristles are held better when they are transferred from the bristle feeding device to the portions of wire in the region of the deflecting rollers and that springing away of the covering during the transfer from the bristle feeding device to the portions of wire is reliably avoided, it is advantageous if the deflecting rollers have teeth for receiving the bristles to be twisted in. The bristles are then securely held in the teeth and prevented from springing away while they are being transferred.

It is expedient if a gripper for gripping the free ends of the wire after the twisting in of the bristles is provided. When wire is fed from a wire reel, the gripping may take place after the cutting off of the fed wire. With the gripper, the round brush can be held at the free ends and the bristle covering can be twisted in further by turning the rotary gripper, in order to improve further the retention of the bristles and/or increase the bristle density in the longitudinal direction of the brush.

In this respect, the gripper may be rotatable in the opposite direction to the rotary gripper, in order to improve the twisting-in effect.

It is expedient if a separating device for detaching the free ends of the wire of the round brush is provided. These free ends, which are still arranged upstream of the deflecting rollers and consequently protrude transversely in relation to the longitudinal direction of the brush, are usually undesired and can thus be removed in a simple manner.

The separating device may in this case be formed as a cutting device. It is also possible that the separating device is formed for gripping the wire and twisting in in this region, the wire being twisted in to such an extent that it tears at the twisting point. For this purpose, the separating device may act on the wire with great pressure in the gripping region or else have notching lugs, which cut into the wire in order to facilitate and speed up the tearing off of the wire.

A further-reaching idea of the invention provides that a transfer device for transferring the round brush to a finishing device is provided.

The following are possible, for example, as finishing: profiling of the bristles (high-low, circular-star-shaped, asymmetrical), incipient melting of the ends of the bristles, grinding or rounding off of the ends of the bristles, attaching items to the twisted-in portions of wire, for example a handle element, a scratch guard or a connecting eyelet. It is also possible to bend around the folded end of the wire or to wind a small rosette on this end of the round brush, so that the covering also protrudes beyond the end of the round brush in the longitudinal direction of the brush. Such brushes may be used for example as bottle brushes, with which the bottom of the bottle can also be cleaned.

The bristle feeding device may preferably have a transporting means for transporting the bristles into the region of the deflecting rollers.

The transporting means may in this case be, for example, a transporting chain, a belt or a band.

This makes it possible to feed the bristles in a portioned manner into the region of the deflecting rollers, where they are twisted in between the portions of wire.

The bristle feeding device may also have a material box with a supply of bristles, from which bristle clusters can be removed by a bristle divider and can be fed to the transporting means. This makes an automatic material feed and continuous operation of the apparatus possible. In the material box there may be provided various bristle material, which before being placed in the material box has been mixed to correspond to the desired mixing ratio. It is also possible, however, for there to be arranged in the material box one or more material separators, which keep different types of bristle material, for example differently colored material or bristles with different surface characteristics or of different materials, separate from one another, and these are removed from the material box by the bristle divider to correspond to the desired covering. The use of a number of material boxes from which bristle material is removed in an alternating manner is also conceivable.

Alternatively, the bristle feeding device may have at least one roller with bristle material and a cutting-to-length device and also a transfer unit for transferring the bristles to the transporting means. The bristles are then unwound from a roller, cut to length and transferred to the transporting means directly in the apparatus.

It is expedient if the bristle feeding device can be positioned between a transfer position, arranged in the region of the deflecting rollers, and a readiness position, drawn back in comparison. For folding the wire at the beginning of the production process and for completing and removing the round brush after fitting it with bristle material, the bristle feeding device may be arranged at a distance from the region of the deflecting rollers, in order to keep this region free for the application element or the gripper or a transfer device. On the other hand, during the feeding of bristles, the bristle feeding device may be arranged directly at the deflecting rollers.

The advancement of the wire is performed by the advancing device on the one hand and a self-induced advancing movement of the rotary gripper during the twisting in of the wire on the other hand. It is also possible, however, that the rotary gripper has a linear drive connected to the control device. With this drive, the round brush can be actively drawn away from the deflecting rollers during the twisting in of the bristle covering, whereby the working speed of the apparatus can be increased. The linear drive is in this case preferably in connection with the control device, in order to set the tensile force by the rotary gripper in relation to the level of the slowing force of the twisting-in rollers.

In addition or as an alternative to the linear drive, the rotary gripper may also be positioned and moved away from the deflecting rollers by the tensile force of a tension spring.

Upstream and downstream of the deflecting rollers there may be provided funnel-like sleeves, in order to facilitate the feeding of the wire during the positioning of the wire upstream of the deflecting device.

Similarly, steady rests may be provided in the positioning path of the wire, in order to support the wire, which is advisable in particular in the case of long portions of wire for producing large, long round brushes.

With regard to the method, the invention is characterized in that a wire is arranged upstream of a rotary gripper, a portion of the wire being respectively arranged on both sides of the rotary gripper, in that the wire is bent around in the region of the rotary gripper to form two portions of wire running approximately parallel to each other and is fed by way of deflecting rollers to the rotary gripper and is gripped by the latter, in that, after the bending around of the wire, the deflecting rollers are brought closer to each other and the portions of wire are thereby pressed further together, in that in the region of the deflecting rollers bristles are fed to the bent-around portions of wire running at least approximately parallel to each other and the portions of wire are twisted by the rotary gripper, and in that the unfolded portions of wire are slowed during the twisting in of the wire. This produces the advantages already described in the explanation of the apparatus according to the invention.

It may be expedient if an advancement control of one of the portions of wire located upstream of the deflecting rollers takes place during the twisting in of the bristles in dependence on the rate of advancement of the other portion of wire.

A preferred embodiment provides that, for forming the portions of wire arranged on both sides of the rotary gripper, wire is unwound from a wire reel from one side of the rotary gripper and past it to the other side of the rotary gripper in such a way that the portion of wire arranged on the side opposite from the wire reel corresponds approximately to the length of the round brush to be produced or is longer to compensate for the shortening of the wire caused by the twisting in. This makes it possible for brushes to be produced in a single operation, without previously prefabricated wires having to be produced in the respective, required length.

The invention also relates to a round brush with bristles twisted in between two portions of wire of a folded wire. According to the invention, the round brush has in the folding region of the wire a functional element connected to the wire such that it cannot be lost during the folding of the wire. This functional element may be, for example, a handle or a protective element.

BRIEF DESCRIPTION OF THE DRAWINGS

The apparatus according to the invention and the method are explained in more detail below on the basis of the drawings, in which, partly schematically.

DETAILED DESCRIPTION OF THE PREFERRED EMBODIMENTS

Figure 1:
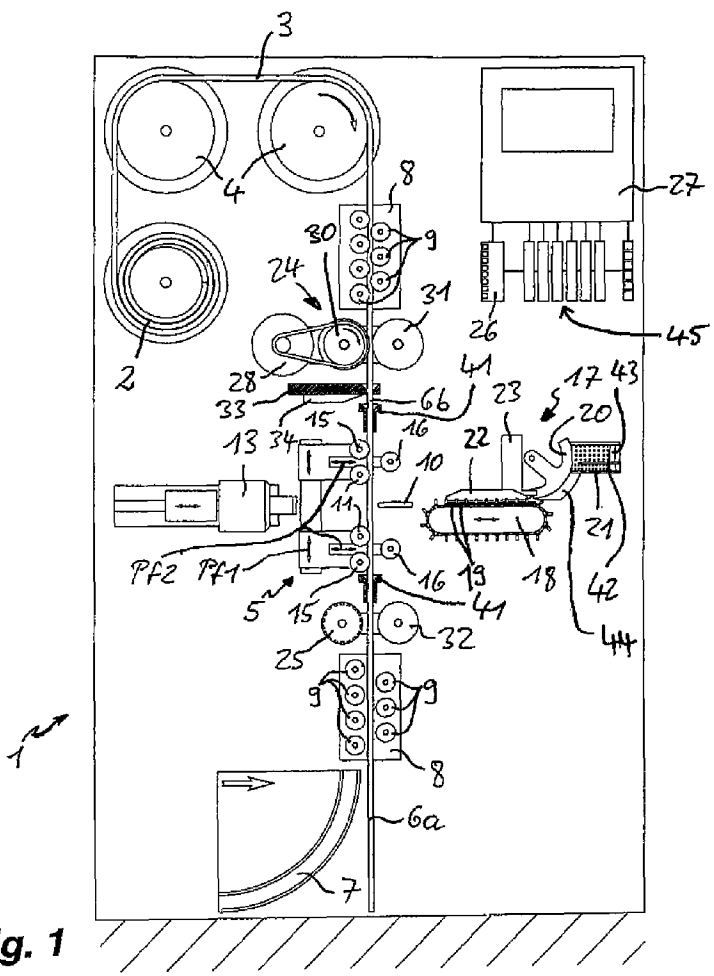
FIG. 1 shows an apparatus for producing round brushes at the beginning of the production operation.

According to FIG. 1, an apparatus, denoted as a whole by 1, for producing round brushes 37 has a wire reel 2 with a wire 3, which is unwound from the wire reel 2 and brought into the region of a deflecting device 5 by way of two deflecting rollers 4. The wire 3 is initially unwound to such an extent that the free end of the wire 3 is positioned as a portion of wire 6*a* past the deflecting device 5. Consequently, there is a portion of wire 6*a*, 6*b* of the unwound wire 3 respectively above and below the deflecting device 5. The portion of wire 6*a*, which forms the free end of the wire 3, is in this case approximately as long as the round brush 37 to be produced, or somewhat longer in order to compensate for the shortening in the main longitudinal direction during twisting in. If the free portion of wire 6*a* is longer than the space available, the wire 3 may be guided through a deflecting unit 7, which in the figures is formed as a hollow guide in the form of a segment of a circle, and thereby bent around, so that the wire 3 can be unwound over a greater length.

Respectively provided on both sides of the deflecting device 5 there is a straightening apparatus 8, with a number of guiding rollers 9, arranged on both sides of the wire 3, for the straight alignment of the portion of wire 6*a* unwound from the wire reel 2, or bent by the deflecting unit 7 and, as explained below, moved back from it. A number of straightening apparatuses 8, arranged one behind the other and offset by 90° in relation to each other in the circumferential direction of the wire, may also be respectively provided in order to ensure that the wire 3 is aligned straight in all dimensions. If the free portion of wire 6*a* is not guided and deflected by the deflecting unit 7, it is also possible to dispense with the straightening apparatus 8 assigned to the deflecting unit 7. On the other hand, the guiding rollers 9 of the straightening apparatus 8 assigned to the deflecting unit 7 may be spaced further from each other during the feeding of the wire 3 (FIG. 1), so that they initially do not apply force to the wire 3 and the feeding of the wire 3, which is in that case still aligned straight, is simplified.

Figure 2:
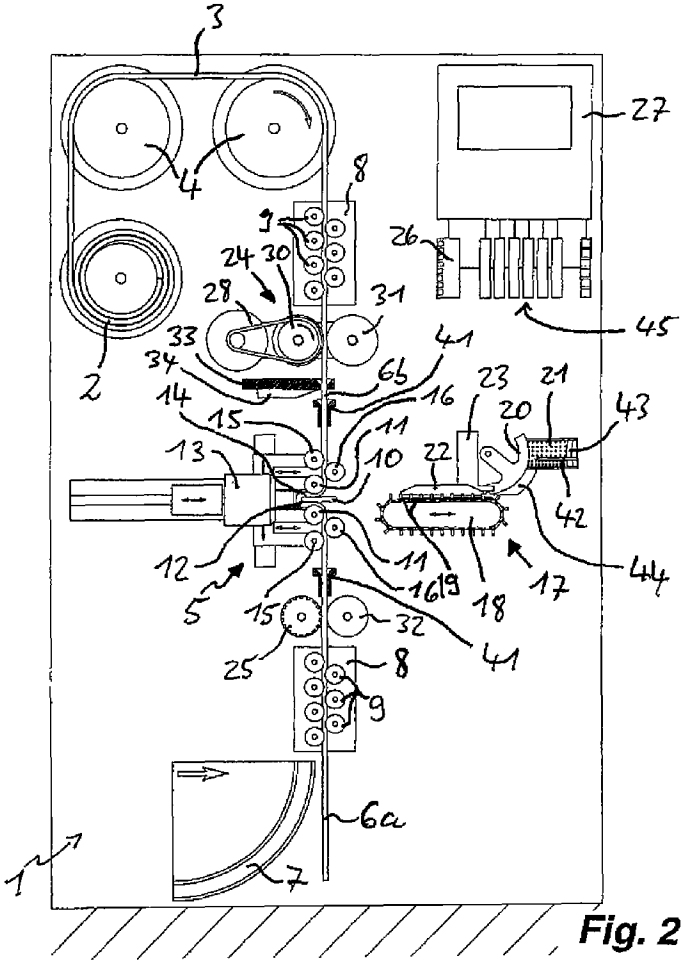
FIG. 2 shows the apparatus from FIG. 1 during the folding of the wire.
Figure 3:
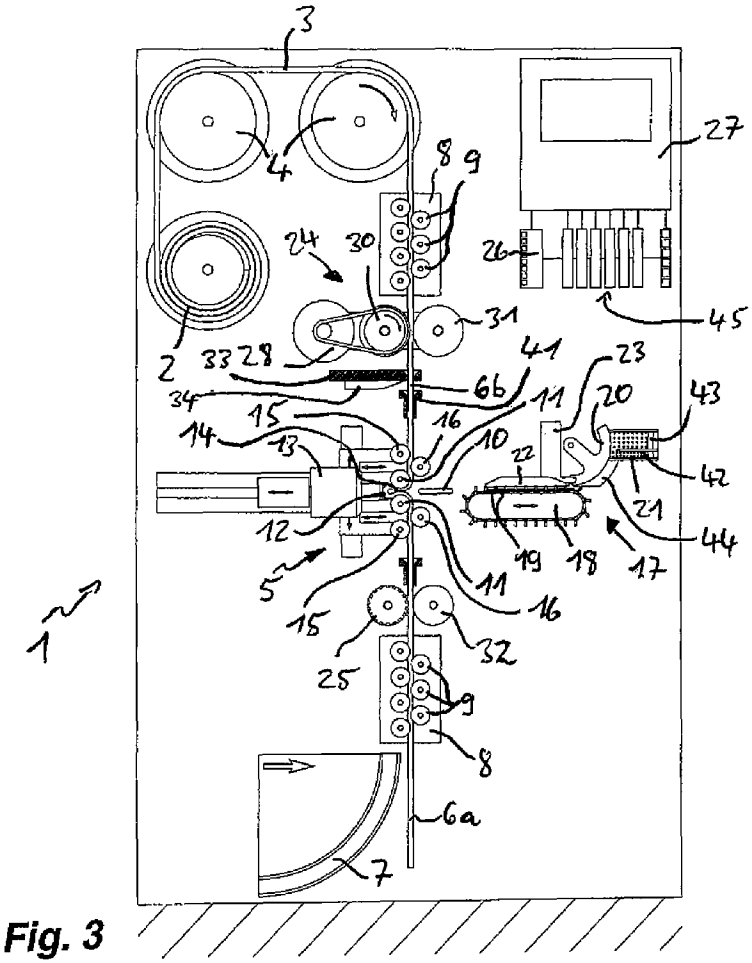
FIG. 3 shows the apparatus from FIG. 2 after the folding of the wire.

After the unwinding of the wire 3 from the wire reel 2 to the required length, force is applied to the wire 3 by an application element 10 and it is folded between two deflecting rollers 11 of the deflecting device 5 (FIG. 2). As indicated in FIG. 1 by the arrows Pf1, the deflecting rollers 11 are adjustable in relation to each other in the longitudinal direction of the wire 3 and, for folding the wire 3, can be positioned into a bending position according to FIG. 2. The folding region 12 of the wire 3 is gripped by a rotary gripper 13, and after the drawing back of the application element 10, the deflecting rollers 11 are brought even closer to each other and into a twisting-in position (FIG. 3), in which the folded portions of wire 14 of the wire 3, running approximately parallel to each other, lie close to each other and the bristle material to be fed can be held in between.

In the region of the deflecting rollers 11, a twisting-in roller 15, arranged adjacently in the longitudinal direction of the wire, and a slowing roller 16, arranged on the other side of the wire 3 between the deflecting roller 11 and the twisting-in roller 15, are respectively provided. The twisting-in rollers 15 and slowing rollers 16 are in each case adjustable together with the respective deflecting roller 11 in the longitudinal direction of the wire and the slowing rollers 16 are also adjustable transversely in relation to the longitudinal direction of the wire (arrows Pf1, FIG. 1), in order to be able to feed the wire 3 (FIG. 1) and apply force to the wire 3 during the folding of the wire 3 and during the twisting in of the covering material (FIGS. 2 to 6).

Figure 4:
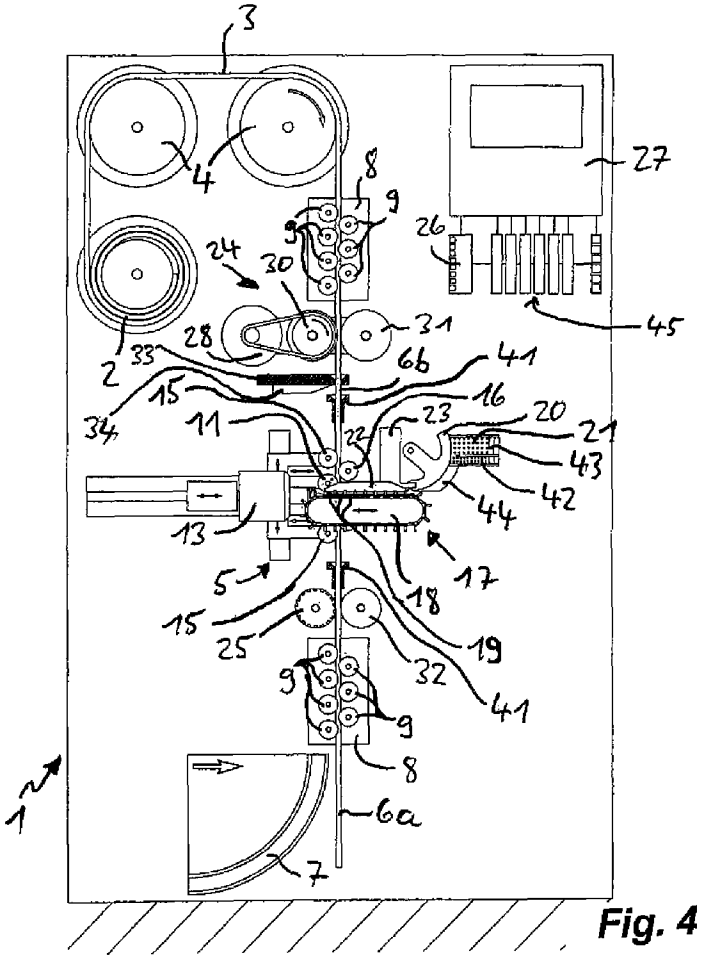
FIG. 4 shows the apparatus according to FIGS. 1 to 3 at the beginning of the twisting in of the bristles.

After the drawing back of the application element 10, a bristle feeding device 17 is brought into the region of the deflecting rollers 11 (FIG. 4). The bristle feeding device 17 has a transporting chain 18 as a transporting element or bristles 19, which are removed from a material box 21 by an arcuate divider 20, moving along a counter piece 44, and are placed onto the transporting chain 18. During the transport on the transporting chain 18, the bristles 19 are held in a defined position by a rest 22 and a pressing-down element 23.

Contained one above the other in the material box 21 are different types of bristle, which are kept separate from each other by a material separator 42. When the bristles are removed with the arcuate divider 20, bristles of both types are taken along, it being possible for the mixing ratio of the types of bristles to be varied by positioning of the material separator 42. It is ensured by a material pressing element 43, which applies pressure to the bristles in the material box 21, that the bristles 19 are ready on the removal side of the material box 21.

In the region of the deflecting rollers 11, the bristles 19 are brought between the deflected portions of wire 14, gripped by them and clamped in between them. As a result, the bristles 19 are securely held directly after being transferred from the transporting chain 18 and flinging away of the covering during the twisting in is reliably avoided. The turning movement of the rotary gripper 13 has the effect that the bristles 19 are fixed between the twisting-in portions of wire 14. The twisting of the portions of wire 14 has the effect that the portions of wire 14 guided between the mounts for the deflecting rollers 11 are shifted to the left by the rotary gripper 13. The rotary gripper may also be drawn to the left by a tension spring (not represented) and/or this linear movement of the rotary gripper may be assisted by a linear drive (likewise not represented).

The advancement of the wire is also assisted by an advancing device 24, which acts on the wire 3 upstream of the deflecting rollers 11 and advances it in the direction of the deflecting device 5. In order that both portions of wire 6*a*, 6*b* move uniformly, the advancement of the free end of the wire 6*a* is measured by a rotary encoder 25. The rotary encoder 25 is connected to a servo controller 26 of a control device 27. The control device 27 may be a regular PC, which also controls further pneumatic or electronic components provided on the apparatus 1, which in turn may communicate with one another. The servo controller 26 for the rotary encoder 25 may, however, also communicate directly with a servomotor control 45, which activates the advancing device 24, so that the control device 27 is bypassed, whereby quicker control of the advancing device 24 is possible. In dependence on the signals of the rotary encoder 25, the drive 28 of the advancing device 24 is controlled by the control device 27 or the servomotor control 45. This makes a uniform, controlled advancement of the wire 3 possible, and consequently reliable twisting in of the bristles 19, whereby flinging away of the covering material is reliably avoided even in the case of high operating speeds and long bristles.

The advancing device 24 has a driver roller 30, driven by the drive 28, and also a counter roller 31, applying force to the wire 3 from the opposite side. Similarly, the rotary encoder is assigned a counter roller 32, between which the wire 3 is guided, the rotary encoder 25 and the counter roller 32 applying force to the wire 3 in order to reliably register its advancing movement.

During the twisting in of the covering material, the slowing rollers 16 are arranged such that they not only guide the wire 3 but apply force and thereby slow it down. This makes it possible to maintain particularly good control over the advancement of the wire. It is thereby also possible with the slowing rollers 16, in particular the slowing roller 16 upstream of the deflecting device 5, to measure the wire tension and to control the advancement of the wire by way of the advancing device 24 in dependence on the wire tension. By varying the force applied to the wire 3 by the slowing rollers 16, the slowing effect can be influenced, whereby the tensile stress on the folded portions of wire 14 can be changed during the twisting in of the bristles 19 and the pull-out resistance of the bristles 19 in the finished round brush 37 can be influenced. The higher the slowing force applied by the slowing rollers 16, the higher the tensile force on the folded portions of wire 14, and the greater the pull-out resistance of the finished round brush 37.

Provided downstream of the advancing device 24 in the advancing direction of the wire is a cutting device 33 with a blade 34 for severing the wire 3 when the desired length has been unwound from the wire reel 2. After the cutting off of the wire 3 with the blade 34, the wire 3 can be twisted in further and thereby moved further to the left by turning the rotary gripper 13, it also being possible for further bristles 19 to be twisted in.

Figure 9:
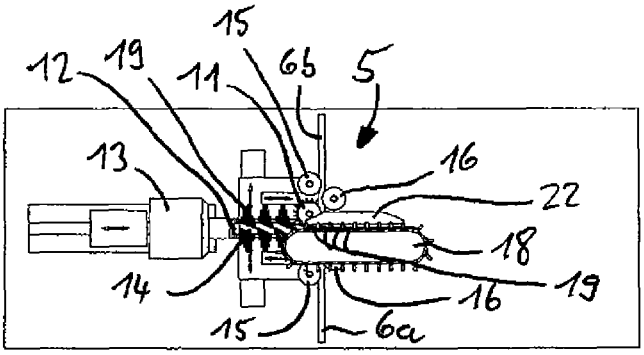
FIG. 9 shows a representation of a detail of the fitting region of the apparatus during the twisting in of the bristles.

The twisting in of the bristles 19 between the deflected portions of wire 14 can also be seen well in the representation of a detail according to FIG. 9. It is also shown there that the deflecting rollers 11 have teeth, which fix the bristles 19 while they are being transported from the transporting chain 18 and prevent flinging away.

Figure 10:
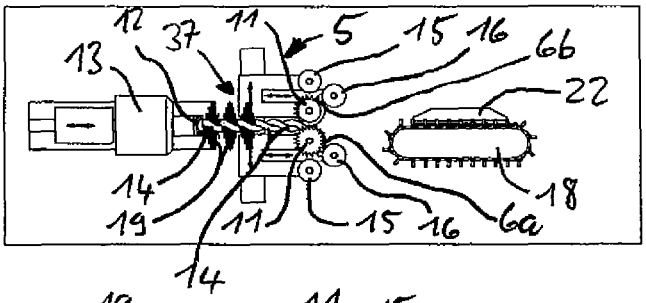
FIG. 10 shows a representation of a detail after complete fitting with bristles.
Figure 11:
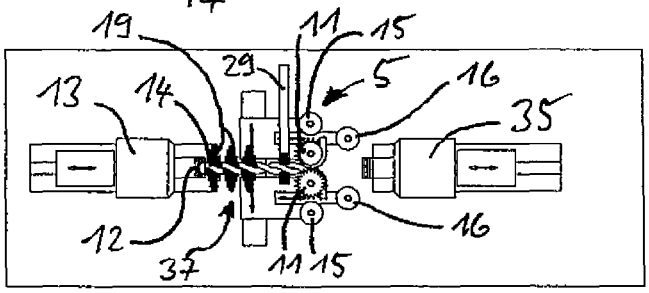
FIG. 11 to FIG. 13 show further working steps after the twisting of the bristles in between the portions of wire.
Figure 12:
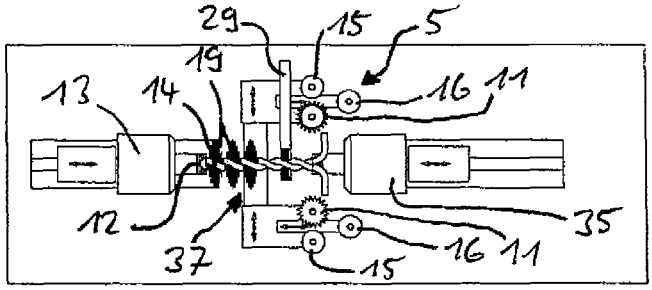

According to FIG. 10, the bristle feeding device 17 has been moved back again and, to form a brush handle, the free ends of the wire are twisted in further, until the ends of the wire 3 are arranged approximately in the region of the deflecting rollers 11. Subsequently, the end region of the wire 3 is gripped by a wire holder 29, so that the twisted-in portions of wire 14 with the bristle covering are held between the rotary gripper 13 and the wire holder 29 (FIG. 11). This allows the deflecting rollers 11 and also the slowing rollers 16 of the deflecting device 5 to be moved apart and release the wire (FIG. 12).

The free ends of the wire may then be gripped by a further gripper 35 and, if required, the wire of the round brush can be twisted in further, in order to increase further the strength of the bristle covering. In this case, the gripper 35 may also be formed as a rotary gripper, which can be turned in the opposite direction to the rotary gripper 13.

Figure 13:
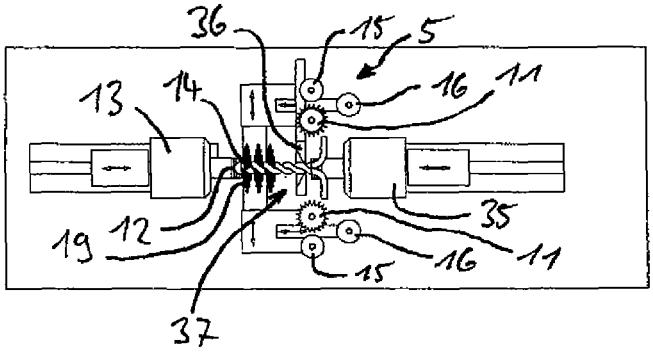

According to FIG. 13, the free, bent-around ends of the wire are detached with a separating device 36, for example a wire cutter. If required, the fully twisted round brush 37 may then be fed to a finishing device, for example for profiling, incipient melting, grinding or rounding off of the ends of the bristles.

Figure 6:
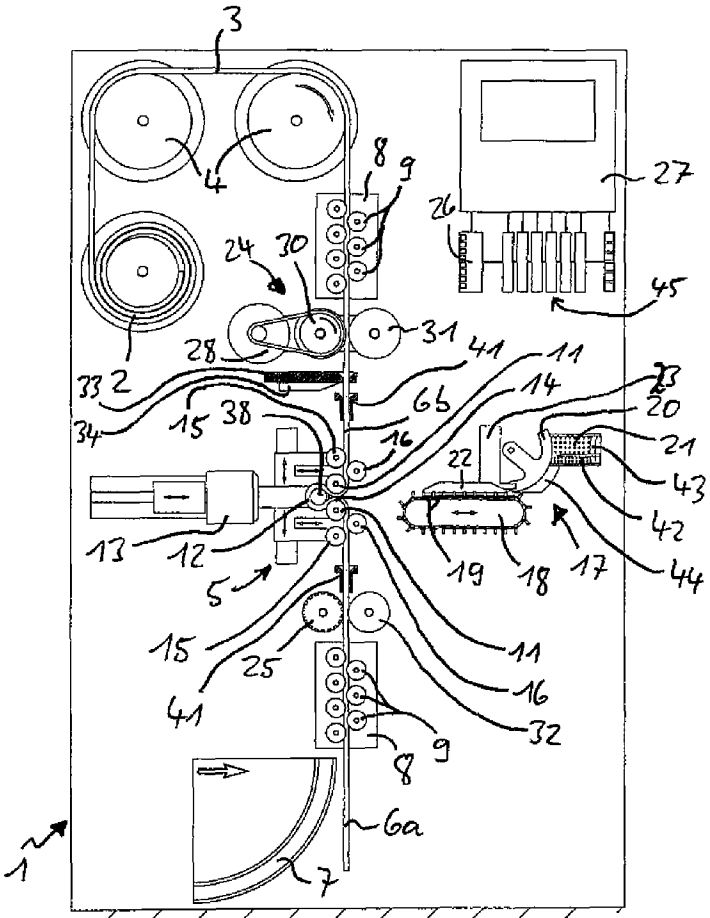
FIG. 6 shows the apparatus from FIG. 5 after the folding of the wire.
Figure 5:
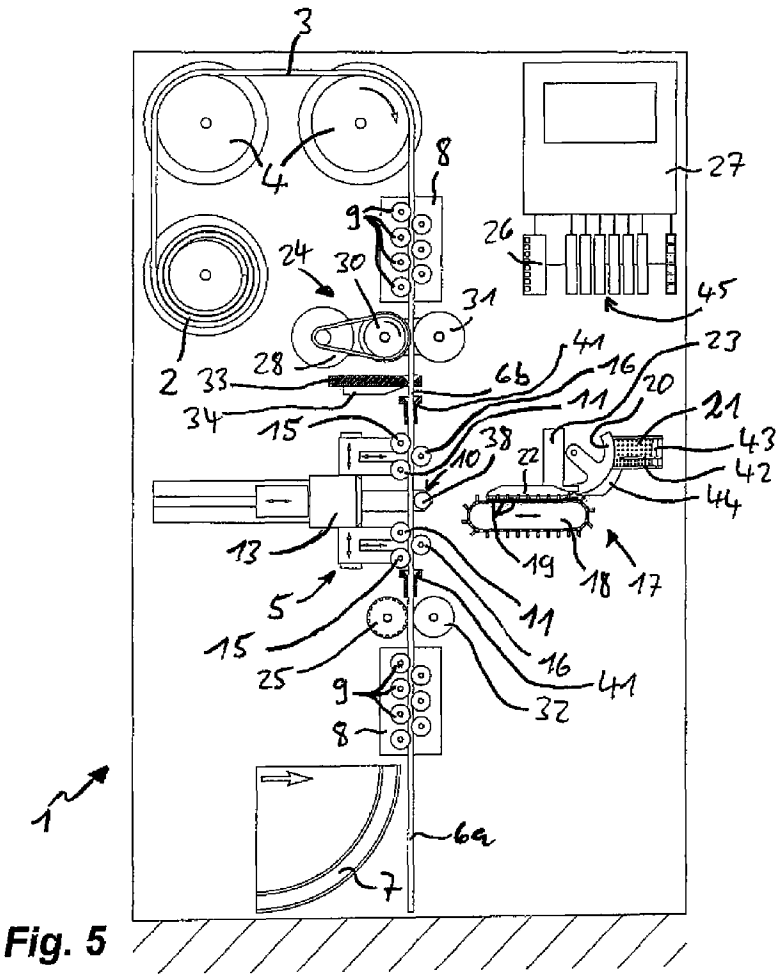
FIG. 5 shows an apparatus similar to FIG. 1 with a gripper finger as an application element.

In the case of the apparatus 1 according to FIGS. 5 and 6, the application element 10 is formed by a gripper finger 38, which is arranged on the rotary gripper 13 and connected to the rotary gripper 13. Before the feeding of the wire 3, the gripper finger 38 is positioned as shown in FIG. 5, so that, after the feeding of the wire 3, said wire is arranged between the gripper finger 38 and the rotary gripper 13. By moving the gripper finger 38 toward the rotary gripper 13, the wire 3 is drawn through between the deflecting rollers 11. Subsequently, the deflecting rollers 11 are brought closer to each other (FIG. 6), so that the gripper finger 38 makes the wire 3 form an eyelet in the folding region.

In the case of the apparatus 1 according to FIGS. 5 and 6, the gripper finger 38 is formed cylindrically with a circular cross section, for the forming of a round eyelet. The gripper finger may, however, also have a different form, for the forming of a corresponding eyelet, for example oval or triangular.

The gripper finger 38 may also be of a two-part configuration, with two part-portions, which are arranged in front of and behind the wire 3 with regard to the plane of the drawing in FIGS. 5 and 6 and together form the overall gripper finger.

Figure 8:
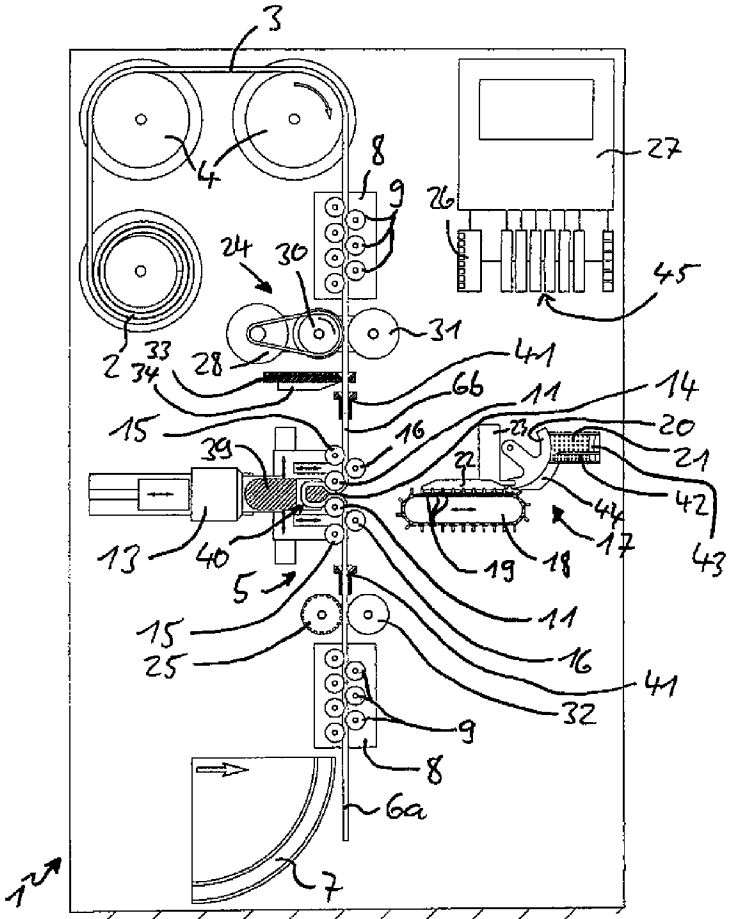
FIG. 8 shows the apparatus according to FIG. 7 after the folding of the wire.
Figure 7:
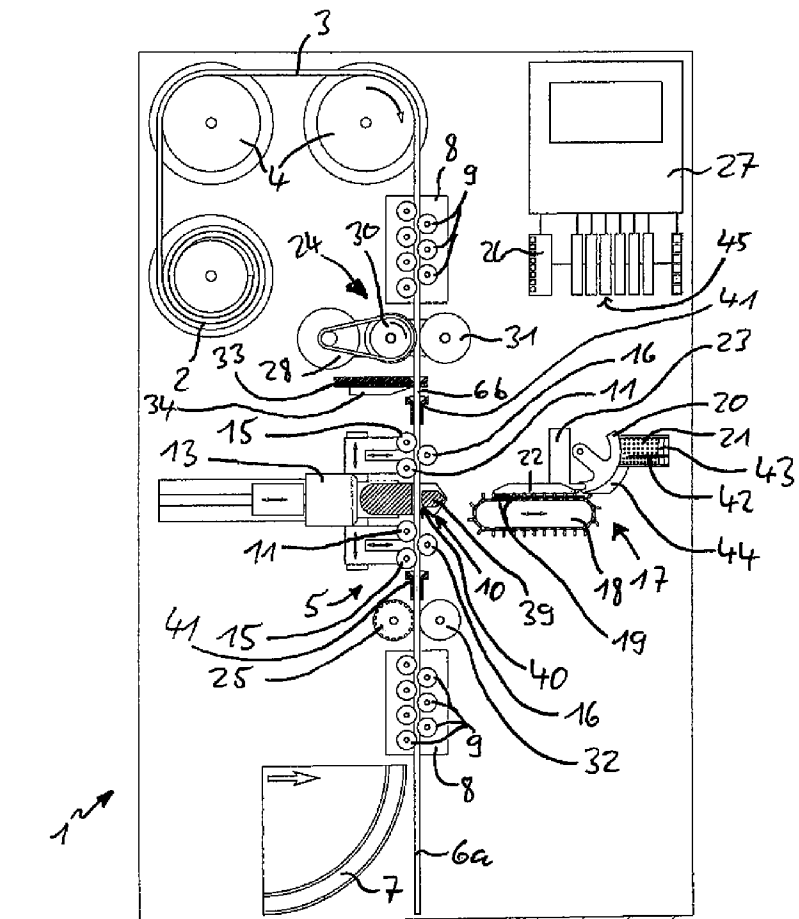
FIG. 7 shows an apparatus similar to FIG. 1 with a functional element on the application element.

In the case of the apparatus 1 according to FIGS. 7 and 8, the application element 10 has a receptacle for a functional element 39. The wire 3 is in this case guided through a clearance 40 of the functional element 39, so that part of the functional element 39 is enclosed by the wire 3 during the displacement of the application element 10 to the left and the functional element 39 is connected to the wire 3 such that it cannot be lost. The functional element 39 may be, for example, a handle or a guard of plastics material, which is consequently firmly held on the finished round brush, and coming away of the functional element 39 is virtually ruled out.

A magazine (not represented) for providing the functional elements 39, from which a functional element 39 is respectively fed automatically to the application element at the beginning of a brush production cycle, may be provided.

In the case of the apparatuses 1 according to FIGS. 1 to 8, guiding-in funnels 41 are provided, in order to facilitate the feeding of the wire 3 in the desired position.

When the wire 3 is fed from the wire reel 2 for the first time, it may initially be brought up to the advancing device 24 manually. The further advancement of the wire 3, until the free end of the wire 3 protrudes beyond the deflecting device 5 to the required length, may then take place by way of the advancing device 24. Similarly, after the cutting off with the cutting device 33 and the completion of a round brush, further wire material may be advanced with the aid of the advancing device 24 to introduce the next production cycle.

If the unwinding of the wire 3 from the wire reel 2 is possible with little expenditure of force, it may also be possible to dispense with the use of the advancing device 24 during the twisting in of the bristles.

The invention claimed is:

1. An apparatus (1) for producing round brushes (37), which have bristles (19) twisted in between two portions of wire (14) of a folded wire, the apparatus (1) comprising a bristle feeding device (17), a rotary gripper (13) for twisting two portions of wire (14) with bristles (19) located between them, a deflecting device (5) with two deflecting rollers (11) spaced apart in a longitudinal direction of a fed wire (3), the rotary gripper (13) is linearly displaceable transversely in relation to the longitudinal direction of the fed wire (3), and is adapted to grip a folded region (12) of the wire (3) that is formed by force being applied by an application element (10) that is adjustable between the deflecting rollers (11) transversely in relation to the longitudinal direction of the wire, the bristle feeding device (17) being adapted to feed the bristles (19) to bent-around portions of wire (14), is located in a region of the deflecting rollers (11), and in a region of the unfolded portions of wire (6*a*, 6*b*) there is respectively provided a device for slowing advancement of the wire.

2. The apparatus as claimed in claim 1, wherein the deflecting rollers (11) are respectively assigned a twisting-in roller (15), arranged at a distance in the direction of the fed wire (3), and at least one slowing roller (16), arranged in between in a wire feeding direction and on a side opposite from the wire (3).

3. The apparatus as claimed in claim 2, wherein the slowing rollers (16) are respectively adjustable transversely in relation to the advancing direction of the wire and transversely in relation to an axial direction thereof.

4. The apparatus as claimed in claim 3, wherein the slowing rollers (16) can be respectively activated and positioned by way of a control unit (27).

5. The apparatus as claimed in claim 1, wherein an advancing device (24) for the wire (3) is provided, which device acts on one of the unfolded portions of wire (6*b*) upstream of one of the deflecting rollers (11) and is in operative connection with a rotary encoder (25) in a region of the other, unfolded portion of wire (6*a*) upstream of the other deflecting roller (11).

6. The apparatus as claimed in claim 5, wherein the advancing device (24) and the rotary encoder (25) are in operative connection with each other via a control device (27).

7. The apparatus as claimed in claim 5, wherein the rotary encoder (25) is connected to a motor control of the advancing device (24).

8. The apparatus as claimed in claim 5, wherein the advancing device (24) has a driver roller (30), with a drive (28), and a counter roller (31), between which the wire (3) can be guided through, a distance between the driver roller (30) and the counter roller (31) during advancement of the wire corresponding at least approximately to a diameter of the wire.

9. The apparatus as claimed in claim 8, wherein the driver roller (30) has a number of circular disks of different diameters arranged one behind another in an axial direction and is adjustable in the axial direction.

10. The apparatus as claimed in claim 8, wherein the driver roller (30) is cylindrically formed and has on a circumference thereof a number of notches spaced apart in an axial direction for wires of different thicknesses and is adjustable in the axial direction.

11. The apparatus as claimed in claim 1, wherein the application element (10) is a bending plate, which is adjustable between the deflecting rollers (11) between a bending position, brought closer to the rotary gripper (13) and applying force to the wire (3) guided past the rotary gripper (13), and a rest position, drawn back in comparison.

12. The apparatus as claimed in claim 1, wherein the application element (10) is a gripper finger (38) arranged on the rotary gripper (13) and linearly displaceable with the rotary gripper (13).

13. The apparatus as claimed in claim 1, wherein the application element (10) has a receptacle for a functional element (39) to apply force to the wire (3).

14. The apparatus as claimed in claim 1, wherein the deflecting rollers (11) are adjustable transversely in relation to a longitudinal direction of the folded portions of wire (14) between a bending position, for the positioning of the application element (10), and a twisting-in position, brought closer to each other in comparison.

15. The apparatus as claimed in claim 1, wherein a wire reel (2) is provided as a wire supply for the wire (3) to be fed.

16. The apparatus as claimed in claim 15, further comprising at least one straightening apparatus (8) located downstream of the wire reel (2) in the advancing direction of the wire, with a number of guiding rollers (9) arranged on both sides of the wire (3) for aligning the wire (3).

17. The apparatus as claimed in claim 1, further comprising a deflecting unit (7) for a free end of the fed wire (3).

18. The apparatus as claimed in claim 1, further comprising a cutting device (33) for severing the wire (3) fed from a wire reel (2).

19. The apparatus as claimed in claim 1, wherein the deflecting rollers (11) have teeth for receiving the bristles (19) to be twisted in.

20. The apparatus as claimed in claim 1, further comprising a gripper (35) for gripping free ends of the wire after twisting in of the bristles (19).

21. The apparatus as claimed in claim 20, wherein the gripper (35) is rotatable in the opposite direction to the rotary gripper (13).

22. The apparatus as claimed in claim 1, further comprising a separating device (36) for detaching free ends of the wire of the round brush (37).

23. The apparatus as claimed in claim 1, further comprising a transfer device for transferring the round brush (37) to a finishing device.

24. The apparatus as claimed in claim 1, wherein the bristle feeding device (17) has a transporting element adapted to transport the bristles (19) into a region of the deflecting rollers (11).

25. The apparatus as claimed in claim 24, wherein the transporting element is a transporting chain (18), a belt or a band.

26. The apparatus as claimed in claim 1, wherein the bristle feeding device (17) has a material box (21) with a supply of bristles, from which the bristles (19) can be removed by a bristle divider and can be fed to a transporting element.

27. The apparatus as claimed in claim 1, wherein the bristle feeding device (17) has at least one roller with bristle material and a cutting-to-length device and also a transfer unit for transferring the bristles to a transporting element.

28. The apparatus as claimed in claim 1, wherein the bristle feeding device (17) is movable between a transfer position, arranged in a region of the deflecting rollers (11), and a readiness position, drawn back in comparison.

29. The apparatus as claimed in claim 1, wherein the rotary gripper (13) has a linear drive connected to the control device (27).

30. A method for producing round brushes (37), in which bristles (19) are twisted in between wires or portions of wire, comprising:

arranging a wire (3) upstream of a rotary gripper (13) that is linearly displaceable transversely in relation to a longitudinal direction of the fed wire (3), a portion (6*a*, 6*b*) of the wire (3) being respectively arranged on both sides of the rotary gripper (13), bending the wire (3) around in a region of the rotary gripper (13) to form two portions of wire (14) running approximately parallel to each other and feeding the wire by way of deflecting rollers (11) to the rotary gripper (13) and gripping the wire in the rotary gripper (13), after the bending around of the wire (3), bring the deflecting rollers (11) closer to each other and pressing the portions of wire (14) thereby further together, in the region of the deflecting rollers (11) feeding bristles (19) to the bent-around portions of wire (14) running at least approximately parallel to each other and twisting the portions of wire (14) together by the rotary gripper (13), and slowing the unfolded portions of wire (6*a*, 6*b*) during the twisting in of the wire (3).

31. The method as claimed in claim 30, wherein an advancement control of one of the portions of wire (6*b*) located upstream of the deflecting rollers (11) takes place during the twisting in of the bristles (19) in dependence on a rate of advancement of the other portion of wire (6*a*).

32. The method as claimed in claim 30, wherein, for forming the portions of wire (6*a*, 6*b*) arranged on both sides of the rotary gripper (13), unwinding the wire (3) from a wire reel (2) from one side of the rotary gripper (13) and past it to an other side of the rotary gripper (13) in such a way that the portion of wire (6*a*) arranged on the side opposite from the wire reel (2) corresponds approximately to a length of the round brush (37) to be produced or is longer to compensate for the shortening of the wire caused by the twisting in.

* * * * *